US007168494B2

(12) United States Patent
Starr et al.

(10) Patent No.: US 7,168,494 B2
(45) Date of Patent: Jan. 30, 2007

(54) DISSOLVABLE DOWNHOLE TOOLS

(75) Inventors: Philip M. Starr, Duncan, OK (US); Loren C. Swor, Duncan, OK (US); Don S. Folds, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 338 days.

(21) Appl. No.: 10/803,662

(22) Filed: Mar. 18, 2004

(65) Prior Publication Data

US 2005/0205264 A1 Sep. 22, 2005

(51) Int. Cl.
*E21B 37/00* (2006.01)

(52) U.S. Cl. ..... 166/379; 166/192

(58) Field of Classification Search ..... 166/376, 166/192

See application file for complete search history.

(56) References Cited

U.S. PATENT DOCUMENTS

| | | | |
|---|---|---|---|
| 3,211,232 | A | 10/1965 | Grimmer |
| 3,768,563 | A | 10/1973 | Blount |
| 4,187,909 | A | 2/1980 | Erbstoesser |
| 5,224,540 | A | 7/1993 | Streich et al. |
| 5,261,488 | A | 11/1993 | Gullet et al. |
| 5,271,468 | A | 12/1993 | Streich et al. |
| 5,333,684 | A | 8/1994 | Walter et al. |
| 5,390,737 | A | 2/1995 | Jacobi et al. |
| 5,479,986 | A | 1/1996 | Gano et al. |
| 5,540,279 | A | 7/1996 | Branch et al. |
| 5,607,017 | A | 3/1997 | Owens et al. |
| 5,685,372 | A | 11/1997 | Gano |
| 5,689,085 | A | 11/1997 | Turner |
| 5,701,959 | A | 12/1997 | Hushbeck et al. |
| 5,765,641 | A | 6/1998 | Shy et al. |
| 5,839,515 | A | 11/1998 | Yuan et al. |
| 5,984,007 | A | 11/1999 | Yuan et al. |
| 5,990,051 | A | 11/1999 | Ischy et al. |
| 6,065,540 | A | 5/2000 | Thomeer et al. |
| 6,102,117 | A | 8/2000 | Swor et al. |
| 6,110,875 | A | 8/2000 | Tjon-Joe-Pin et al. |
| 6,161,622 | A | 12/2000 | Robb et al. |

(Continued)

FOREIGN PATENT DOCUMENTS

| | | |
|---|---|---|
| EP | 0 681 087 A2 | 11/1995 |

OTHER PUBLICATIONS

Foreign communication from related counterpart application dated Jun. 7, 2005.

*Primary Examiner*—William P Neuder
(74) *Attorney, Agent, or Firm*—John W. Wustenberg; Conley Rose, P.C.

(57) ABSTRACT

A disposable downhole tool comprises a material that dissolves when exposed to a chemical solution, an ultraviolet light, a nuclear source, or a combination thereof. In an embodiment, the material comprises an epoxy resin, a fiberglass, or a combination thereof. In another embodiment, the material comprises a fiberglass and a binding agent. The material may also be customized to achieve a desired dissolution rate of the tool. In an embodiment, the disposable downhole tool further comprises an enclosure for storing the chemical solution. The tool may also comprise an activation mechanism for releasing the chemical solution from the enclosure. In an embodiment, the disposable downhole tool is a frac plug. In another embodiment, the tool is a bridge plug. In yet another embodiment, the tool is a packer.

48 Claims, 7 Drawing Sheets

U.S. PATENT DOCUMENTS

| | | | | |
|---|---|---|---|---|
| 6,220,349 | B1 | 4/2001 | Vargus et al. | |
| 6,318,460 | B1 | 11/2001 | Swor et al. | |
| 6,378,606 | B1 | 4/2002 | Swor et al. | |
| 6,394,180 | B1 | 5/2002 | Berscheidt et al. | |
| 6,394,185 | B1 | 5/2002 | Constien | |
| 6,481,497 | B2 | 11/2002 | Swor et al. | |
| 6,491,116 | B2 | 12/2002 | Berscheidt et al. | |
| 6,561,270 | B1 * | 5/2003 | Budde | 166/153 |
| 6,666,275 | B2 | 12/2003 | Neal et al. | |
| 2003/0168214 | A1 * | 9/2003 | Sollesnes | 166/250.08 |
| 2003/0183391 | A1 | 10/2003 | Hriscu et al. | |

* cited by examiner

DISSOLVABLE DOWNHOLE TOOLS

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to dissolvable downhole tools and methods of removing such tools from wellbores. More particularly, the present invention relates to downhole tools comprising materials that dissolve when exposed to a chemical solution, an ultraviolet light, a nuclear source, or a combination thereof, and methods and systems for dissolving such downhole tools in situ.

BACKGROUND OF THE INVENTION

A wide variety of downhole tools may be used within a wellbore in connection with producing hydrocarbons or reworking a well that extends into a hydrocarbon formation. Downhole tools such as frac plugs, bridge plugs, and packers, for example, may be used to seal a component against casing along the wellbore wall or to isolate one pressure zone of the formation from another. Such downhole tools are well known in the art.

After the production or reworking operation is complete, these downhole tools must be removed from the wellbore. Tool removal has conventionally been accomplished by complex retrieval operations, or by milling or drilling the tool out of the wellbore mechanically. Thus, downhole tools are either retrievable or disposable. Disposable downhole tools have traditionally been formed of drillable metal materials such as cast iron, brass and aluminum. To reduce the milling or drilling time, the next generation of downhole tools comprises composites and other non-metallic materials, such as engineering grade plastics. Nevertheless, milling and drilling continues to be a time consuming and expensive operation. Therefore, a need exists for disposable downhole tools that are removable without being milled or drilled out of the wellbore, and for methods of removing disposable downhole tools without tripping a significant quantity of equipment into the wellbore.

SUMMARY OF THE INVENTION

The present invention relates to a disposable downhole tool comprising a material that dissolves when exposed to a chemical solution, an ultraviolet light, a nuclear source, or a combination thereof. In an embodiment, the material comprises an epoxy resin, a fiberglass, or a combination thereof. In another embodiment, the material comprises a fiberglass and a binding agent. The material may also be customized to achieve a desired dissolution rate of the tool. In an embodiment, the disposable downhole tool further comprises an enclosure for storing a chemical solution. The tool may also comprise an activation mechanism for releasing the chemical solution from the enclosure. In various embodiments, the tool comprises a frac plug, a bridge plug, a packer, or another type of wellbore zonal isolation device.

In another aspect, the present invention relates to a method for performing a downhole operation wherein a downhole tool is disposed within a wellbore comprising dissolving the tool within the wellbore via a chemical solution, an ultraviolet light, a nuclear source, or a combination thereof. In an embodiment, the chemical solution for dissolving the tool within the wellbore comprises a caustic fluid, an acidic fluid, or a combination thereof. The chemical solution may also be customized to achieve a desired dissolution rate of the tool. In various embodiments, the chemical solution may be applied to the tool before performing the downhole operation, during the downhole operation, or after performing the downhole operation. In various embodiments, the chemical solution is applied to the tool by dispensing the chemical solution into the wellbore; by lowering a frangible object containing the chemical solution into the wellbore and breaking the frangible object; by extending a conduit into the wellbore and flowing the chemical solution through the conduit onto the tool; or by moving a dart within the wellbore and engaging the dart with the tool to release the chemical solution.

In yet another aspect, the present invention relates to a system for applying a chemical solution to a downhole tool to dissolve the tool within a wellbore. In an embodiment, the system further comprises an enclosure for containing the chemical solution. The system may also include an activation mechanism for releasing the chemical solution from the enclosure. In various embodiments, the activation mechanism may be mechanically operated, hydraulically operated, electrically operated, or timer-controlled, or operated via a communication means. In various embodiments, the enclosure is disposed on the tool, lowered to the tool on a slick line, or dropped into the wellbore to engage the tool. In an embodiment, the system further comprises a conduit extending into the wellbore to apply the chemical solution onto the tool.

DETAILED DESCRIPTION

Figure 1:
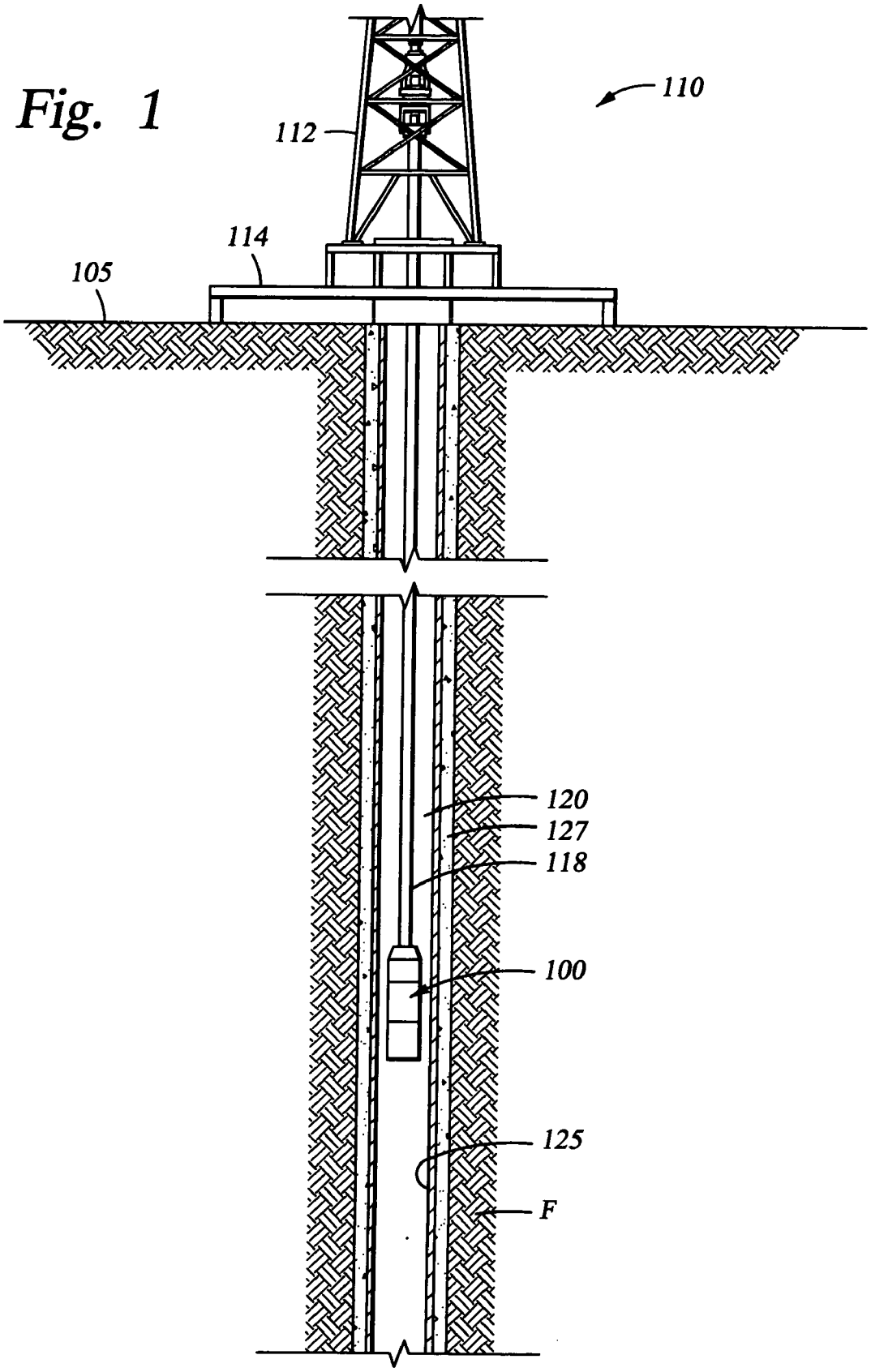
FIG. 1 is a schematic, cross-sectional view of an exemplary operating environment depicting a dissolvable downhole tool being lowered into a wellbore extending into a subterranean hydrocarbon formation.

FIG. 1 schematically depicts an exemplary operating environment for a dissolvable downhole tool 100. As depicted, a drilling rig 110 is positioned on the earth's surface 105 and extends over and around a wellbore 120 that penetrates a subterranean formation F for the purpose of recovering hydrocarbons. At least the upper portion of the wellbore 120 may be lined with casing 125 that is cemented 127 into position against the formation F in a conventional manner. The drilling rig 110 includes a derrick 112 with a rig floor 114 through which a cable 118, such as a wireline, jointed pipe, or coiled tubing, for example, extends downwardly from the drilling rig 110 into the wellbore 120. The cable 118 suspends an exemplary dissolvable downhole tool 100, which may comprise a frac plug, a bridge plug, a packer, or another type of wellbore zonal isolation device, for example, as it is being lowered to a predetermined depth within the wellbore 120 to perform a specific operation. The drilling rig 110 is conventional and therefore includes a motor driven winch and other associated equipment for extending the cable 118 into the wellbore 120 to position the tool 100 at the desired depth.

While the exemplary operating environment depicted in FIG. 1 refers to a stationary drilling rig 110 for lowering and setting the dissolvable downhole tool 100 within the wellbore 120, one of ordinary skill in the art will readily appreciate that mobile workover rigs, well servicing units, and the like, could also be used to lower the tool 100 into the wellbore 120.

Figure 2:
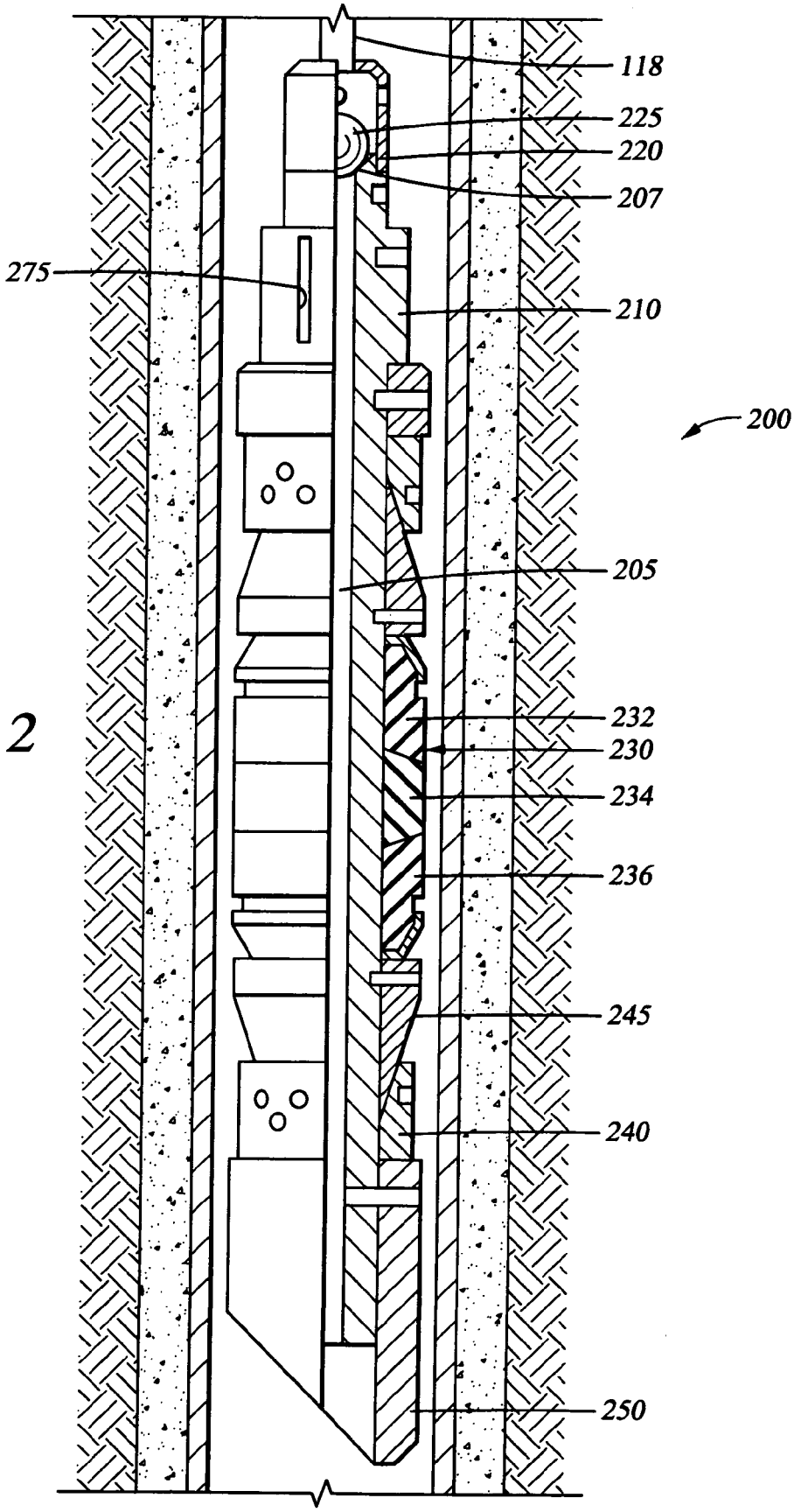
FIG. 2 is an enlarged side view, partially in cross section, of an embodiment of a dissolvable downhole tool comprising a frac plug being lowered into a wellbore.

The dissolvable downhole tool 100 may take a variety of different forms. In an embodiment, the tool 100 comprises a plug that is used in a well stimulation/fracturing operation, commonly known as a "frac plug." FIG. 2 depicts an exemplary dissolvable frac plug, generally designated as 200, as it is being lowered into a wellbore. The frac plug 200 comprises an elongated tubular body member 210 with an axial flowbore 205 extending therethrough. A cage 220 is formed at the upper end of the body member 210 for retaining a ball 225 that acts as a one-way check valve. In particular, the ball 225 seals off the flowbore 205 to prevent flow downwardly therethrough, but permits flow upwardly through the flowbore 205. A packer element assembly 230, which may comprise an upper sealing element 232, a center sealing element 234, and a lower sealing element 236, extends around the body member 210. One or more slips 240 are mounted around the body member 210 below the packer assembly 230. The slips 240 are guided by a mechanical slip body 245. A tapered shoe 250 is provided at the lower end of the body member 210 for guiding and protecting the frac plug 200 as it is lowered into the wellbore 120. An optional enclosure 275 for storing a chemical solution may also be mounted on the body member 210 or may be formed integrally therein. In an embodiment, the enclosure 275 is formed of a frangible material.

At least some of the components comprising the frac plug 200 are formed from materials that dissolve when exposed to a chemical solution, an ultraviolet light, a nuclear source, or a combination thereof. These components may be formed of any dissolvable material that is suitable for service in a downhole environment and that provides adequate strength to enable proper operation of the plug 200. By way of example only, one such material is an epoxy resin that dissolves when exposed to a caustic fluid. Another such material is a fiberglass that dissolves when exposed to an acid. Still another such material is a binding agent, such as an epoxy resin, for example, with glass reinforcement that dissolves when exposed to a chemical solution of caustic fluid or acidic fluid. Any of these exemplary materials could also degrade when exposed to an ultraviolet light or a nuclear source. Thus, the materials may dissolve from exposure to a chemical solution, or from exposure to an ultraviolet light or a nuclear source, or by a combination thereof. The particular material matrix used to form the dissolvable components of the frac plug 200 are customizable for operation in a particular pressure and temperature range, or to control the dissolution rate of the plug 200 when exposed to a chemical solution, an ultraviolet light, a nuclear source, or a combination thereof. Thus, a dissolvable frac plug 200 may operate as a 30-minute plug, a three-hour plug, or a three-day plug, for example, or any other timeframe desired by the operator. Alternatively, the chemical solution may be customized, and/or operating parameters of the ultraviolet light source or nuclear source may be altered, to control the dissolution rate of the plug comprising a certain material matrix.

Figure 3:
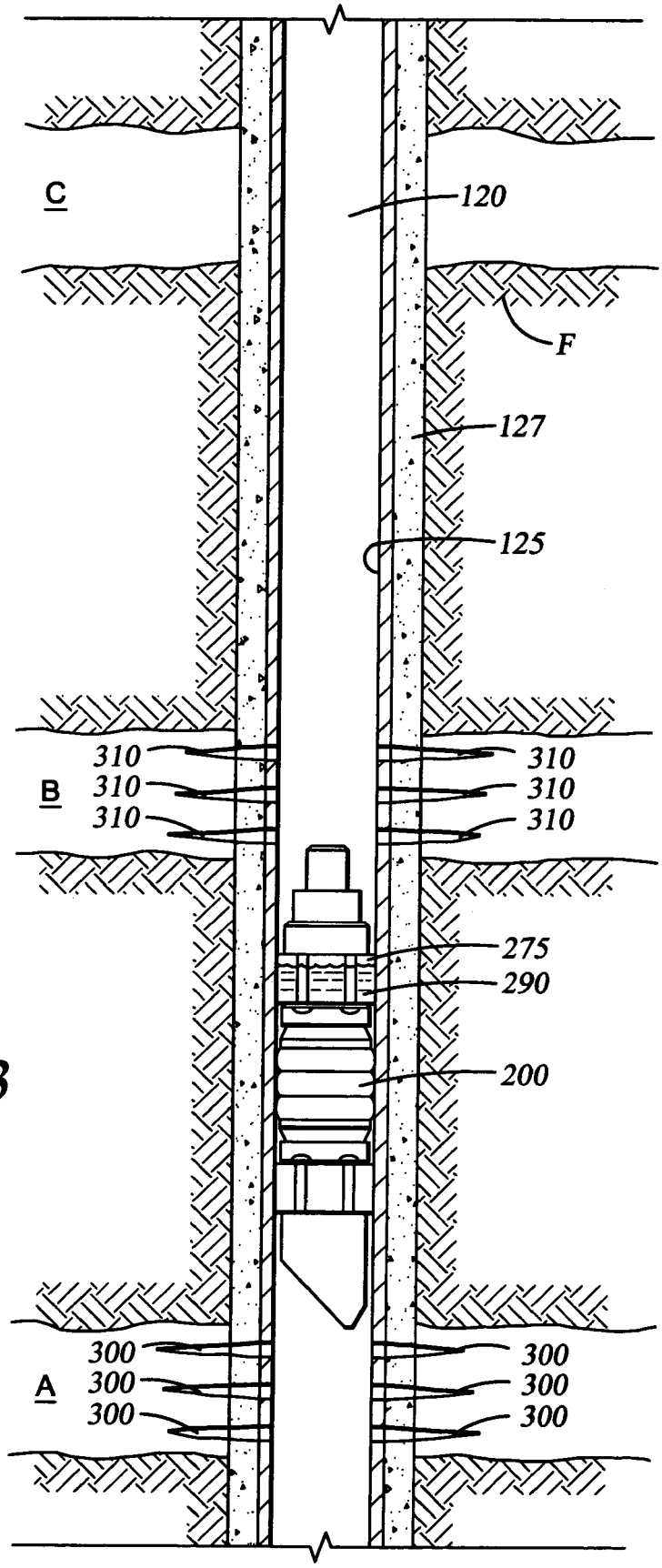
FIG. 3 is an enlarged cross-sectional side view of a wellbore having a representative dissolvable downhole tool with an optional enclosure installed therein.

In operation, the frac plug 200 of FIG. 2 may be used in a well stimulation/fracturing operation to isolate the zone of the formation F below the plug 200. Referring now to FIG. 3, the frac plug 200 is shown disposed between producing zone A and producing zone B in the formation F. In a conventional well stimulation/fracturing operation, before setting the frac plug 200 to isolate zone A from zone B, a plurality of perforations 300 are made by a perforating tool (not shown) through the casing 125 and cement 127 to extend into producing zone A. Then a well stimulation fluid is introduced into the wellbore 120, such as by lowering a tool (not shown) into the wellbore 120 for discharging the fluid at a relatively high pressure or by pumping the fluid directly from the drilling rig 110 into the wellbore 120. The well stimulation fluid passes through the perforations 300 into producing zone A of the formation F for stimulating the recovery of fluids in the form of oil and gas containing hydrocarbons. These production fluids pass from zone A, through the perforations 300, and up the wellbore 120 for recovery at the drilling rig 10.

The frac plug 200 is then lowered by the cable 118 to the desired depth within the wellbore 120, and the packer element assembly 230 is set against the casing 125 in a conventional manner, thereby isolating zone A as depicted in FIG. 3. Due to the design of the frac plug 200, the ball 225 within cage 220 will unseal the flowbore 205, such as by unseating from the upper surface 207 of the flowbore 205, for example, to allow fluid from isolated zone A to flow upwardly through the frac plug 200. However, the ball 225 will seal off the flowbore 205, such as by seating against the upper surface 207 of the flowbore 205, for example, to prevent flow downwardly into the isolated zone A. Accordingly, the production fluids from zone A continue to pass through the perforations 300, into the wellbore 120, and upwardly through the flowbore 205 of the frac plug 200, before flowing into the wellbore 120 above the frac plug 200 for recovery at the rig 110.

After the frac plug 200 is set into position as shown in FIG. 3, a second set of perforations 310 may then be formed through the casing 125 and cement 127 adjacent intermediate producing zone B of the formation F. Zone B is then treated with well stimulation fluid, causing the recovered fluids from zone B to pass through the perforations 310 into the wellbore 120. In this area of the wellbore 120 above the frac plug 200, the recovered fluids from zone B will mix with the recovered fluids from zone A before flowing upwardly within the wellbore 120 for recovery at the drilling rig 110.

If additional well stimulation/fracturing operations will be performed, such as recovering hydrocarbons from zone C, additional frac plugs 200 may be installed within the wellbore 120 to isolate each zone of the formation F. Each frac plug 200 allows fluid to flow upwardly therethrough from the lowermost zone A to the uppermost zone C of the formation F, but pressurized fluid cannot flow downwardly through the frac plug 200.

After the fluid recovery operations are complete, the frac plug 200 must be removed from the wellbore 120. In this context, as stated above, at least some of the components of the frac plug 200 are dissolvable when exposed to a chemical solution, an ultraviolet light, a nuclear source, or a combination thereof, thereby eliminating the need to mill or drill the frac plug 200 out of the wellbore 120. Thus, by exposing the frac plug 200 to a chemical solution, an ultraviolet light, a nuclear source, or a combination thereof, at least some of its components will dissolve, causing the frac plug 200 to release from the casing 125, and the undissolved components of the plug 200 to fall to the bottom of the wellbore 120.

There are a great variety of methods and systems for applying a chemical solution to the frac plug 200. The chemical solution may be applied before or after the frac plug 200 is installed within the wellbore 120. Further, the chemical solution may be applied before, during, or after the fluid recovery operations. For those embodiments where the chemical solution is applied before or during the fluid recovery operations, the dissolvable material, the chemical solution, or both may be customized to ensure that the frac plug 200 dissolves over time while remaining intact during its intended service.

The chemical solution may be applied by means internal to or external to the frac plug 200. In an embodiment, an optional enclosure 275 is provided on the frac plug 200 for storing the chemical solution 290 as depicted in FIG. 3. An activation mechanism (not shown), such as a slideable valve, for example, may be provided to release the chemical solution 290 from the optional enclosure 275 onto the frac plug 200. This activation mechanism may be timer-controlled or operated mechanically, hydraulically, electrically, or via communication means, such as a wireless signal, for example. This embodiment would be advantageous for fluid recovery operations using more than one frac plug 200, since the activation mechanism for each plug 200 could be actuated as desired to release the chemical solution 290 from the enclosure 275 and dissolve each plug 200 at the appropriate time with respect to the fluid recovery operations.

Figure 4A:
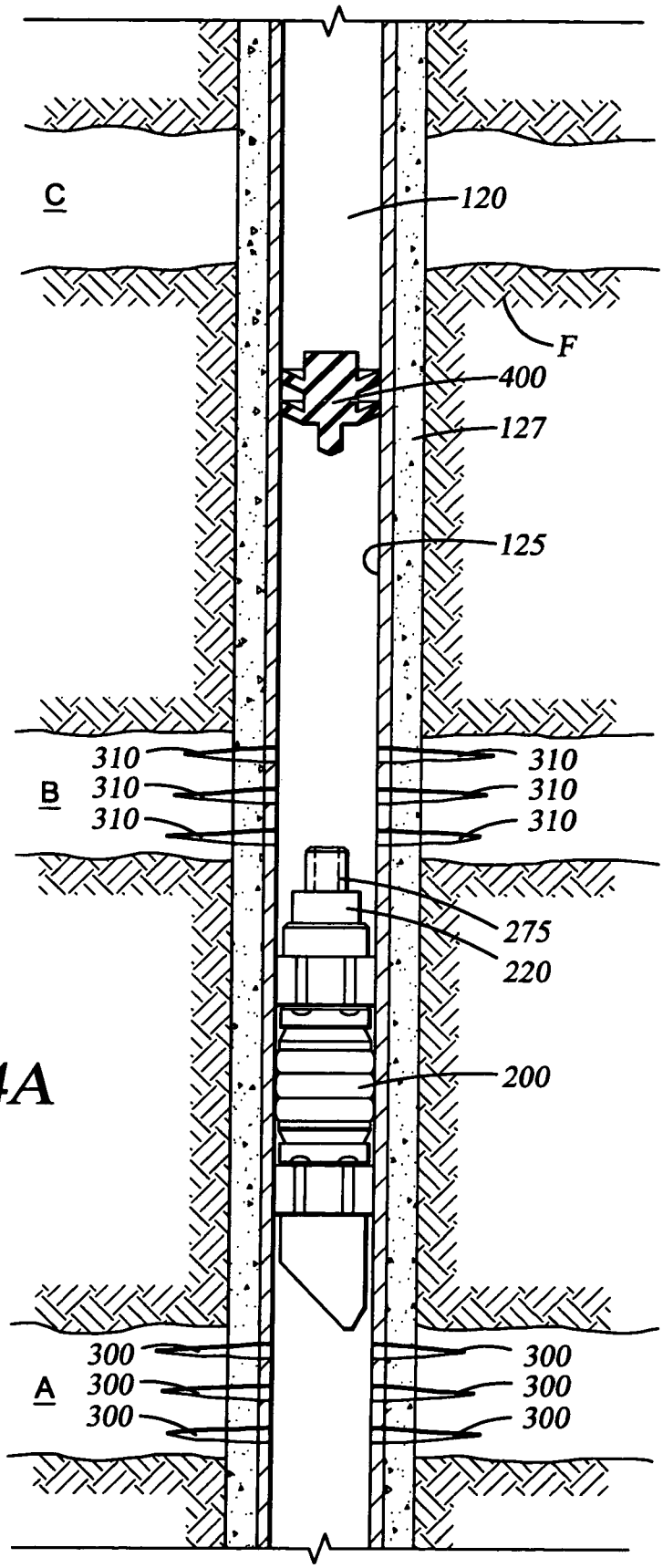
FIG. 4A is an enlarged cross-sectional side view of a wellbore with a dissolvable downhole tool installed therein and with a pumpable dart moving in the wellbore toward the tool.

As depicted in FIG. 4A, in another embodiment, a pumpable dart 400 releases the chemical solution 290 onto the frac plug 200. As depicted, the pumpable dart 400 engages and seals against the casing 125 within the wellbore 120. Therefore, fluid must be pumped into the wellbore 120 behind the pumpable dart 400 to force the dart 400 to move within the wellbore 120. In one embodiment, the optional enclosure 275 on the frac plug 200 is positioned above the cage 220 on the uppermost end of the frac plug 200, and the pumpable dart 400 is moved by fluid pressure within the wellbore 120 to engage the enclosure 275. In an embodiment, the pumpable dart 400 actuates the activation mechanism to mechanically release the chemical solution from the enclosure 275 onto the frac plug 200. In another embodiment, the optional enclosure 275 is frangible, and the pumpable dart 400 engages the enclosure 275 with enough force to break it, thereby releasing the chemical solution onto the frac plug 200. In yet another embodiment, the chemical solution is stored within the pumpable dart 400, which is frangible. In this embodiment, the pumpable dart 400 is moved by fluid pressure within the wellbore 120 and engages the frac plug 200 with enough force to break the dart 400, thereby releasing the chemical solution onto the plug 200.

Figure 4B:
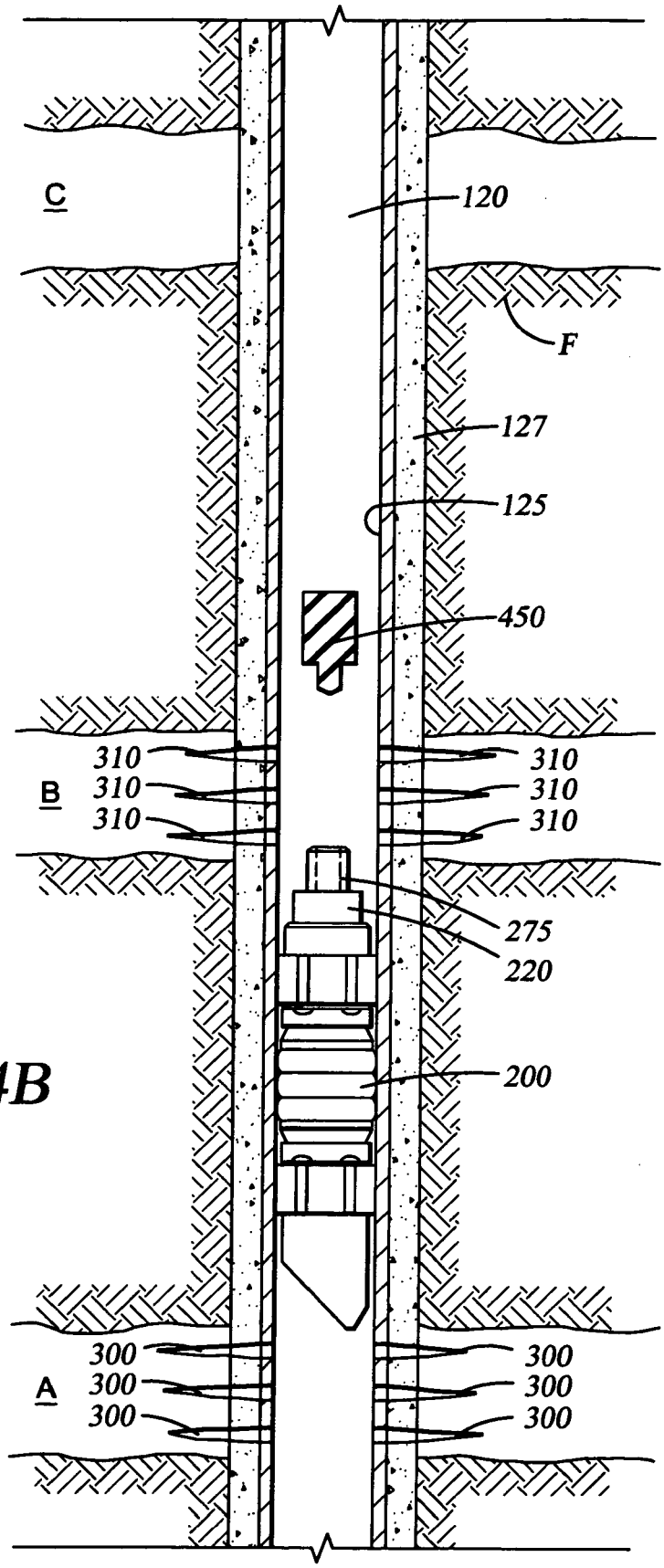
FIG. 4B is an enlarged cross-sectional side view of a wellbore with a dissolvable downhole tool installed therein and with a gravity dart moving in the wellbore toward the tool.

As depicted in FIG. 4B, in another embodiment, a gravity dart 450 may be used to release the chemical solution 290 onto the frac plug 200. Unlike the pumpable dart 400, the gravity dart 450 does not engage or seal against the casing 125 within the wellbore 120, and fluid flow is not required to move the dart 450 within the wellbore 120. Instead, the gravity dart 450 moves by free falling within the wellbore 120. The various embodiments and methods of using a pumpable dart 400 to release the chemical solution 290 onto the frac plug 200, as described above, apply also to the gravity dart 450.

Figure 5:
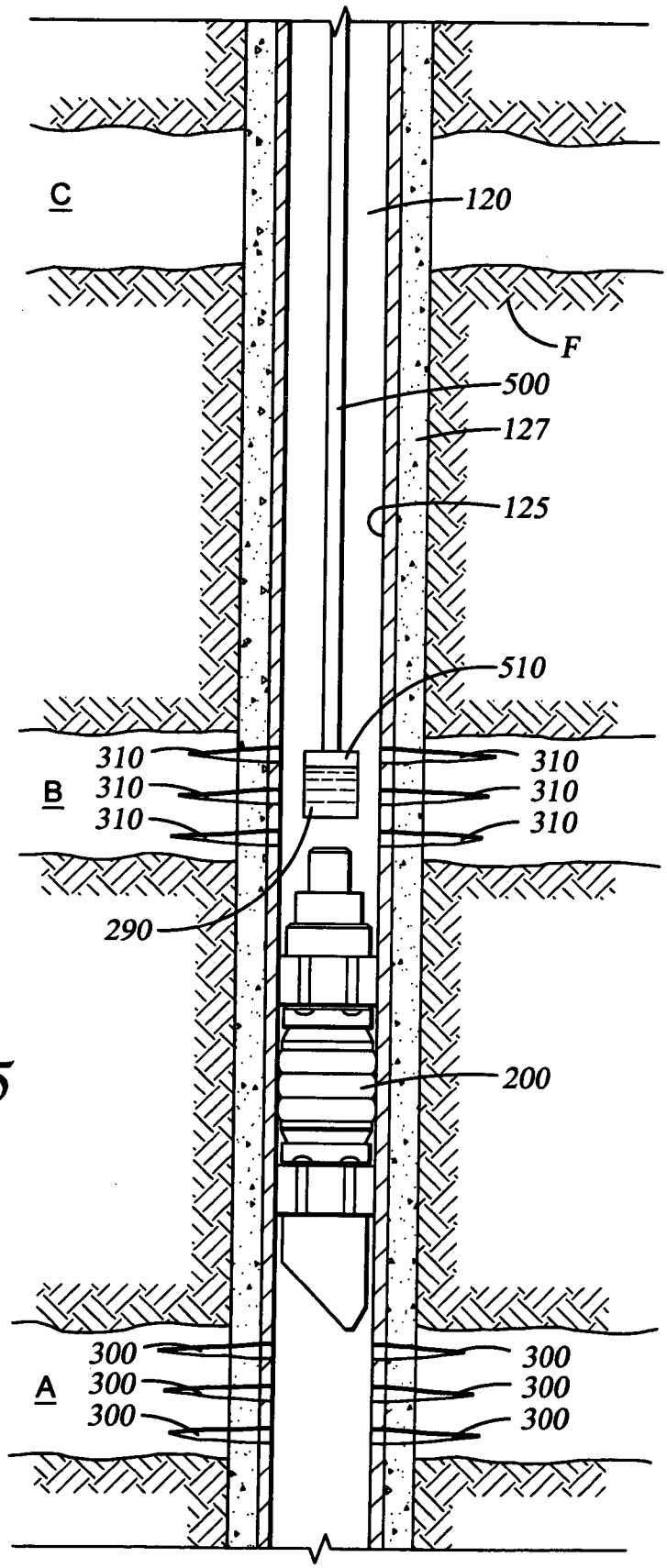
FIG. 5 is an enlarged cross-sectional side view of a wellbore with a dissolvable downhole tool installed therein and with a line lowering a frangible object containing chemical solution towards the tool.

Referring now to FIG. 5, in another embodiment, a slick line 500 may be used to lower a container 510 filled with chemical solution 290 adjacent the frac plug 200 to release the chemical solution 290 onto the plug 200. In an embodiment, the container 510 is frangible and is broken upon engagement with the frac plug 200 to release the chemical solution 290 onto the plug 200. In various other embodiments, the chemical solution 290 may be released from the container 510 via a timer-controlled operation, a mechanical operation, a hydraulic operation, an electrical operation, or via a communication means, such as a wireless signal, for example.

In another aspect, rather than using the slick line 500 of FIG. 5 to lower a container 510 filled with chemical solution 290, the slick line 500 may be used instead to lower an ultraviolet light source (not shown) or a nuclear source (not shown) in the vicinity of the frac plug 200. Exposure to one of these sources will dissolve at least some components of the frac plug 200, thereby causing the frac plug 200 to release from the casing 125, and the undissolved components of the plug 200 to fall to the bottom of the wellbore 120. In an embodiment, the frac plug 200 may also be exposed to a chemical solution 290 in addition to exposing the plug 200 to an ultraviolet light or nuclear source.

Figure 6:
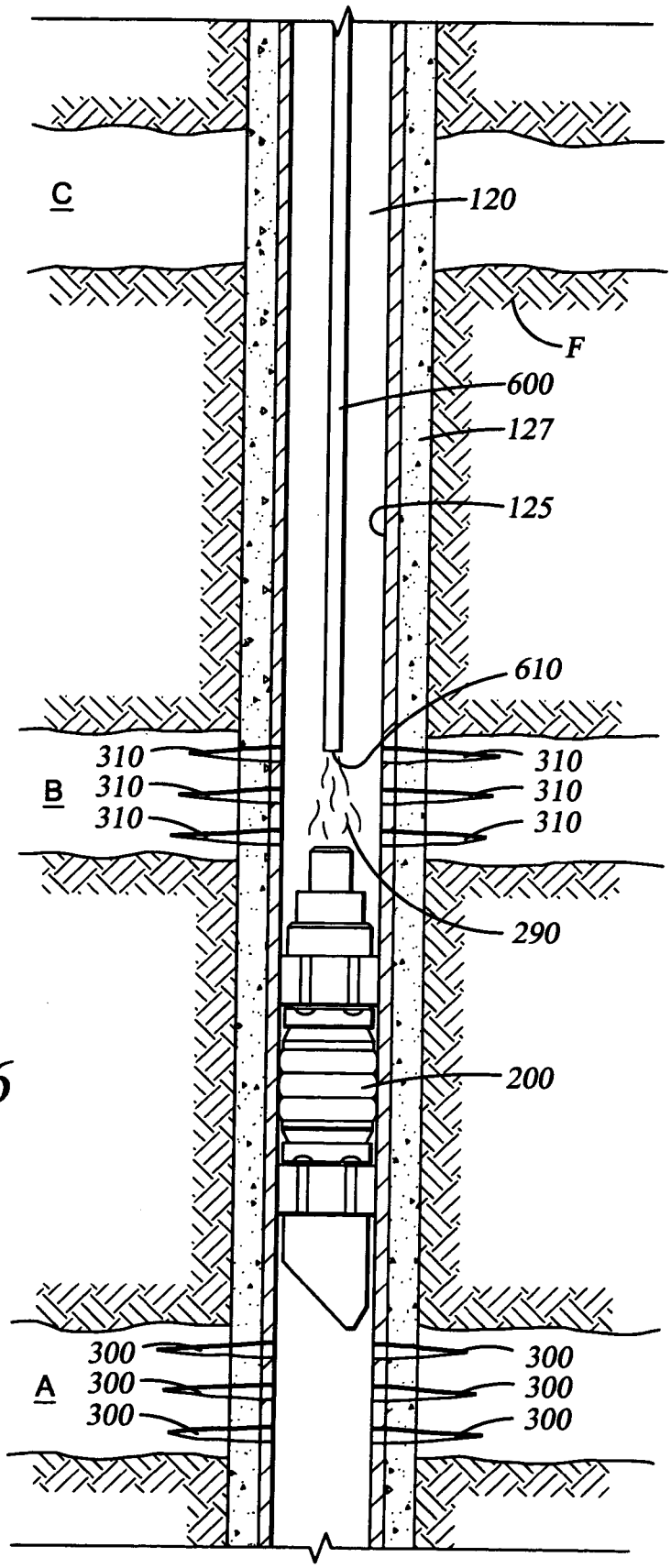
FIG. 6 is an enlarged cross-sectional side view of a wellbore with a dissolvable downhole tool installed therein and with a conduit extending towards the tool to dispense chemical solution.

FIG. 6 depicts another embodiment of a system for applying a chemical solution 290 to the frac plug 200 comprising a conduit 600, such as a coiled tubing or work string, that extends into the wellbore 120 to a depth where the terminal end 610 of the conduit 600 is adjacent the chemical solution 290 onto the frac plug 200. Chemical solution 290 may then flow downwardly through the conduit 600 to spot the frac plug 200. Alternatively, if the chemical solution 290 is more dense than the other fluids in the wellbore 120, the chemical solution 290 could be dispensed by injecting it directly into the wellbore 120 at the drilling rig 110 to flow downwardly to the frac plug 200 without using conduit 600. In another embodiment, the chemical solution 290 may be dispensed into the wellbore 120 during fluid recovery operations, such that the frac plug 200 starts to dissolve over time during its service. In a preferred embodiment, the fluid that is circulated into the wellbore 120 during the downhole operation comprises the chemical solution 290 required to dissolve the frac plug 200, or any other type of dissolvable downhole tool 100.

Removing a dissolvable downhole tool 100, such as the frac plug 200 described above, from the wellbore 120 is more cost effective and less time consuming than removing conventional downhole tools, which requires making one or more trips into the wellbore 120 with a mill or drill to gradually grind or cut the tool away. The foregoing descriptions of specific embodiments of the dissolvable tool 100, and the systems and methods for removing the dissolvable tool 100 from the wellbore 120 have been presented for purposes of illustration and description and are not intended to be exhaustive or to limit the invention to the precise forms disclosed. Obviously many other modifications and variations are possible. In particular, the type of dissolvable downhole tool 100, or the particular components that make up the downhole tool 100 could be varied. For example, instead of a frac plug 200, the dissolvable downhole tool 100 could comprise a bridge plug, which is designed to seal the wellbore 120 and isolate the zones above and below the bridge plug, allowing no fluid communication in either direction. Alternatively, the dissolvable downhole tool 100 could comprise a packer that includes a shiftable valve such that the packer may perform like a bridge plug to isolate two formation zones, or the shiftable valve may be opened to enable fluid communication therethrough.

While various embodiments of the invention have been shown and described herein, modifications may be made by one skilled in the art without departing from the spirit and the teachings of the invention. The embodiments described here are exemplary only, and are not intended to be limiting. Many variations, combinations, and modifications of the invention disclosed herein are possible and are within the scope of the invention. Accordingly, the scope of protection is not limited by the description set out above, but is defined by the claims which follow, that scope including all equivalents of the subject matter of the claims.

What is claimed is:

1. A method for performing a downhole operation wherein a downhole tool is disposed within a well bore comprising:

dissolving the tool within the well bore via a chemical solution, wherein the chemical solution is applied to the tool by dispensing the chemical solution into the well bore;

wherein the dispensing step comprises:

lowering a frangible object containing the chemical solution into the well bore; and breaking the frangible object.

2. The method of claim 1 wherein the tool is fabricated from a material comprising:

epoxy resin, fiberglass, or a combination thereof.

3. The method of claim 1 wherein the chemical solution comprises: a caustic fluid, an acidic fluid, or a combination thereof.

4. The method of claim 1 further comprising fabricating the tool from a material that may be customized to achieve a desired dissolution rate of the tool.

5. The method of claim 1 wherein the chemical solution may be customized to achieve a desired dissolution rate of the tool.

6. The method of claim 1 wherein the chemical solution is applied to the tool before performing the downhole operation.

7. The method of claim 1 wherein the chemical solution is applied to the tool during the downhole operation.

8. The method of claim 1 wherein the tool comprises a frac plug, a bridge plug, or a packer.

9. A method for performing a downhole operation wherein a downhole tool is disposed within a well bore comprising:

dissolving the tool within the well bore via a chemical solution, wherein the chemical solution is applied to the tool by dispensing the chemical solution into the well bore;

wherein the dispensing step comprises:

lowering a conduit into the well bore; and flowing the chemical solution through the conduit onto the tool.

10. The method of claim 9 wherein the tool is fabricated from a material comprising:

epoxy resin, fiberglass, or a combination thereof.

11. The method of claim 9 wherein the chemical solution comprises: a caustic fluid, an acidic fluid, or a combination thereof.

12. The method of claim 9 wherein the chemical solution may be customized to achieve a desired dissolution rate of the tool.

13. The method of claim 9 wherein the chemical solution is applied to the tool before or after performing the downhole operation.

14. The method of claim 9 wherein the chemical solution is applied to the tool during the downhole operation.

15. The method of claim 9 wherein the tool comprises a frac plug, a bridge plug, or a packer.

16. A method for performing a downhole operation wherein a downhole tool is disposed within a well bore comprising:

dissolving the tool within the well bore via a chemical solution;

moving a dart within the well bore; and engaging the dart with the tool to release the chemical solution.

17. The method of claim 16 wherein the tool is fabricated from a material comprising: epoxy resin, fiberglass, or a combination thereof.

18. The method of claim 16 wherein the tool is fabricated from a material comprising: a fiberglass and a binding agent.

19. The method of claim 16 wherein the chemical solution comprises: a caustic fluid, an acidic fluid, or a combination thereof.

20. The method of claim 16 further comprising fabricating the tool from a material that may be customized to achieve a desired dissolution rate of the tool.

21. The method of claim 16 wherein the chemical solution may be customized to achieve a desired dissolution rate of the tool.

22. The method of claim 16 wherein the chemical solution is applied to the tool before performing the downhole operation.

23. The method of claim 16 wherein the chemical solution is applied to the tool during the downhole operation.

24. The method of claim 16 wherein the chemical solution is applied to the tool after performing the downhole operation.

25. The method of claim 16 wherein the dart contains the chemical solution.

26. The method of claim 16 wherein the tool contains the chemical solution.

27. The method of claim 16 wherein the moving step comprises pumping a fluid into the well bore behind the dart.

28. The method of claim 16 wherein the moving step comprises allowing the dart to free fall by gravity.

29. The method of claim 16 wherein the tool comprises a frac plug, a bridge plug, or a packer.

30. A system for applying a chemical solution to a downhole tool to dissolve the tool within a well bore comprising:

a frangible enclosure that contains the chemical solution;

wherein the enclosure is broken to release the chemical; and wherein the enclosure is lowered to the tool on a slick line.

31. The system of claim 30 further comprising an activation mechanism for releasing the chemical solution from the enclosure.

32. The system of claim 31 wherein the activation mechanism is mechanically, hydraulically, or electrically operated.

33. The system of claim 31 wherein the activation mechanism is operated by a communications means.

34. The system of claim 31 wherein the activation mechanism is timer-controlled.

35. The system of claim 30 wherein the tool is formed of a material comprising: epoxy resin, fiberglass, or a combination thereof.

36. The system of claim 30 wherein the chemical solution comprises: a caustic fluid, an acidic fluid, or a combination thereof.

37. The system of claim 30 wherein the tool comprises a frac plug, a bridge plug, or a packer.

38. A system for applying a chemical solution to a downhole tool to dissolve the tool within a well bore comprising:

a frangible enclosure that contains the chemical solution;

wherein the enclosure is broken to release the chemical; and wherein the enclosure is dropped into the well bore to engage the tool.

39. The system of claim 38 further comprising an activation mechanism for releasing the chemical solution from the enclosure.

40. The system of claim 39 wherein the activation mechanism is mechanically operated.

41. The system of claim 39 wherein the activation mechanism is hydraulically operated.

42. The system of claim 39 wherein the activation mechanism is electrically operated.

43. The system of claim 39 wherein the activation mechanism is operated by a communications means.

44. The system of claim 39 wherein the activation mechanism is timer-controlled.

45. The system of claim 38 wherein the tool is formed of a material comprising: epoxy resin, fiberglass, or a combination thereof.

46. The system of claim 38 wherein the tool is formed of a material comprising: a fiberglass and a binding agent.

47. The system of claim 38 wherein the chemical solution comprises: a caustic fluid, an acidic fluid, or a combination thereof.

48. The system of claim 38 wherein the tool comprises a frac plug, a bridge plug, or a packer.

* * * * *